US007040723B2

(12) United States Patent
Matus, Jr.

(10) Patent No.: US 7,040,723 B2
(45) Date of Patent: May 9, 2006

(54) MODULAR FOOD GUARD APPARATUS AND SYSTEMS AND METHODS OF USE THEREOF

(75) Inventor: Jose Orlando Matus, Jr., Atlanta, GA (US)

(73) Assignee: Elemental Ideas, LLC, Gainesville, GA (US)

( * ) Notice: Subject to any disclaimer, the term of this patent is extended or adjusted under 35 U.S.C. 154(b) by 43 days.

(21) Appl. No.: 10/243,234

(22) Filed: Sep. 13, 2002

(65) Prior Publication Data

US 2003/0047086 A1 Mar. 13, 2003

Related U.S. Application Data

(60) Provisional application No. 60/318,899, filed on Sep. 13, 2001.

(51) Int. Cl.
*A47B 96/06* (2006.01)

(52) U.S. Cl. ..... 312/140.4; 312/137

(58) Field of Classification Search ..... 312/114, 312/116, 137, 140.4, 313, 231; 108/1, 6, 108/8, 147.14; 248/222.51, 225.11, 225.21
See application file for complete search history.

(56) References Cited

U.S. PATENT DOCUMENTS

| | | | | |
|---|---|---|---|---|
| 2,486,966 | A | 11/1949 | Mitchell | 312/313 |
| 2,517,467 | A * | 8/1950 | Culver | 211/86.01 |
| 3,404,930 | A | 10/1968 | Cafiero et al. | 312/313 |
| 3,738,606 | A * | 6/1973 | Millen | 248/449 |
| 3,921,539 | A | 11/1975 | Berger | 108/8 |
| 5,213,401 | A | 5/1993 | Hatcher | 312/322 |
| 5,306,077 | A | 4/1994 | Trevaskis | 312/323 |
| 5,584,545 | A | 12/1996 | LaVaute et al. | 312/137 |
| 6,101,954 | A * | 8/2000 | Rein et al. | 108/50.02 |
| 6,132,018 | A | 10/2000 | McGrath | 312/140.4 |
| 6,588,863 | B1 * | 7/2003 | Yatchak et al. | 312/140.4 |

FOREIGN PATENT DOCUMENTS

DE 3907597 * 4/1990

OTHER PUBLICATIONS

Advertisement Brochure—Z Guard, Brass Smith Incorporated, 1999, pp. 1-4.

* cited by examiner

*Primary Examiner*—James O. Hansen
(74) *Attorney, Agent, or Firm*—Gardner Groff Santos & Greenwald, P.C.

(57) ABSTRACT

A modular food guard apparatus including at least one vertical mounting member, at least one first bracket member, and at least one second bracket member. The first and the second bracket members have different constructions and are arranged and configured to be removably secured to the at least one vertical mounting member interchangeably.

10 Claims, 14 Drawing Sheets

MODULAR FOOD GUARD APPARATUS AND SYSTEMS AND METHODS OF USE THEREOF

CROSS-REFERENCE TO RELATED APPLICATION

This application claims priority to copending U.S. provisional application entitled, "Modular Sneeze Guard," having Ser. No. 60/318,899, filed Sep. 13, 2001, which is entirely incorporated herein by reference.

TECHNICAL FIELD

The present invention is generally related to food service stations and, more particularly, is related to modular food guards that include moveable and interchangeable brackets.

BACKGROUND OF THE INVENTION

Generally, a food guard is used to protect food that is to be served from a food service station. The food guard protects the food from contamination from the breath of customers that are requesting or self-serving food from a fast food bar, cafeteria food bar, or other similar food bar. Generally, a food service station includes a food service line or counter that includes some or all of the following: hot or cold food pans, soup wells, chafing dishes, and a breath protection device or sneeze guard. The food guard is typically attached to the food service counter. The food guard is positioned to protect the food from airborne bacteria, contaminants, the breath, sneezing, or coughing of customers. The food guard has a transparent shield made of glass or other material, which is attached to a support structure. The shield ensures protection of the food while often allowing accessibility as well.

In order for a food guard to be effective, it must intersect what is considered the "breath zone." This zone is determined by 1) constructing an imaginary vertical line from the front edge of a serving counter up to a height of about 4'-6" and about 5'-6" from the floor and 2) constructing an imaginary line from the 4'-6" intersection to the front edge of the food zone and 3) constructing an imaginary line from the 5'-6" height to the rear edge of the food zone. The food zone is the area where exposed food will be displayed—generally a food pan, soup well, chafing dish, or similar device that is generally set back about 3" to about 6" from the front edge of the counter. A glass shield or barrier must intersect the breath zone in order to prevent the contamination of food from airborne bacteria from the breath of customers. As well, per health code requirements such as Underwriter Laboratories (UL) Sanitation Code and National Sanitation Foundation (NSF) Standard 2, a food shield must have minimal gaps, cracks, and the like that may trap food particles and other materials that can possibly cause contamination of the food. Existing permanent food guard designs frequently have gaps between the food shields and support structure that do not meet the noted health standards.

In general, food guards are custom designed for a particular food service station with which they are to be used. As such, typical food guards tend to be individually constructed systems that do not include interchangeable parts that are easily removed and/or added to the overall structure. Therefore, existing food guards are not expandable or adaptable such that they can accommodate changes to the lay out of the food service station, i.e., the addition of additional food items and serving trays. Moreover, the existing custom designed food guards do not lend themselves to timely repairs by the owner because the individual pieces are not interchangeable. Therefore, to either expand or repair existing food guards frequently requires the services of a third party and the construction of an entirely new food guard.

As well, food guards are frequently used for different applications in a number of different circumstances. One circumstance involves using the food guard in an attendant-serving mode. In this mode, the customer is restricted from being able to touch or reach the food by way of a transparent shield, which can be in any of a number of configurations. However, the attendant can hand the food to the customer over the top of the food guard or under the guard if there is enough clearance between the food guard and the counter of the food-serving device. Another circumstance in which a food guard can be used is in a self-serve mode. Here, the shield of the food guard is angled or positioned so that a customer can serve himself food through the clearance between the shield and the food service device. The shield still provides protection from contamination from the breath of the customer because it is positioned so as to intersect the "breath zone." The angle of the shield may need to be varied depending on the position of the food in the food serving station and the customer. Food that is farther away from the customer requires sufficient clearance between the shield and the food service station to enable access to the food. Therefore, depending on the circumstance, more or less clearance may be needed to allow accessibility, while maintaining "breath zone" coverage. In addition, different degrees of accessibility are often needed from meal to meal and from event to event thereby requiring a food guard that is adjustable.

Generally, the shields of currently used food guards are in fixed, non-adjustable positions (e.g., in the vertical or angled position). A disadvantage to this arrangement is that different types of food guards are required for different serving circumstances, thereby increasing costs considerably. Moreover, although food guards exist that have adjustable shields, adjusting the positions of those shields is typically a cumbersome process that may require more than one operator.

Thus, a heretofore-unaddressed need exists in the industry to address the aforementioned deficiencies and inadequacies.

SUMMARY OF THE INVENTION

The present invention provides an apparatus and method of using a modular food guard. One embodiment of the present invention provides a modular food guard apparatus. The apparatus includes at least one vertical mounting member, at least one first bracket member, and at least one second bracket member. The first and the second bracket members have different constructions and are arranged and configured to be removably secured to the at least one vertical mounting member interchangeably.

A further embodiment provides a method of converting a modular food guard from a first embodiment to a second embodiment. The method includes the steps of disengaging a securing means from a vertical mounting member, removing a first bracket member from the vertical mounting member, removably securing a second bracket member to the vertical mounting member with the securing means, wherein the first and second bracket members have different constructions.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present invention provides an apparatus and method of using a modular food guard. The present invention overcomes at least one of the disadvantages discussed above for at least the reason that the present invention provides a readily adjustable modular food guard. For example, various embodiments include a food guard that can be readily modified according to an operator's desires. In general, an embodiment of the present invention includes a plurality of interchangeable brackets, one or more of vertical-mounting members, and a shield. The vertical-mounting members are attached to a food-serving device. The brackets are removably attached to the vertical-mounting member and the shield is attached to the brackets. The brackets are interchangeable with various other brackets such that the configuration of the food guard can be modified as desired.

Figure 1A:
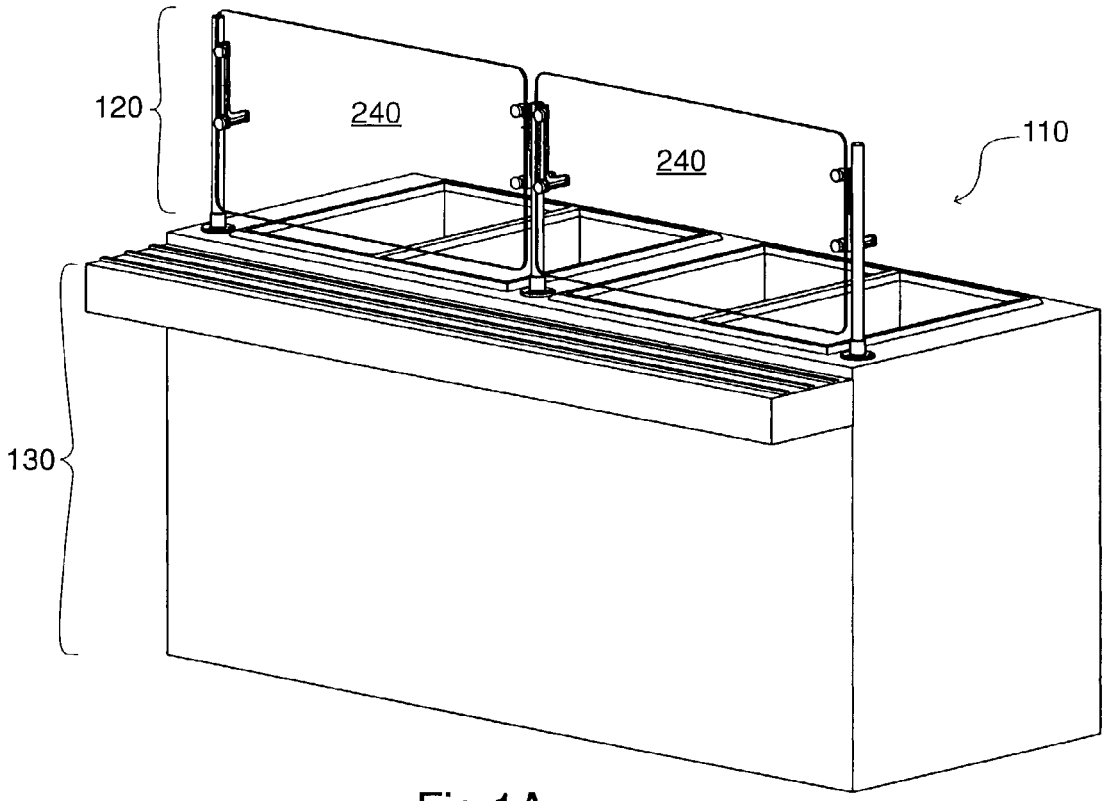
FIGS. 1A and 1B are perspective views of an embodiment of the modular food guard attached to a food service station.
Figure 1B:
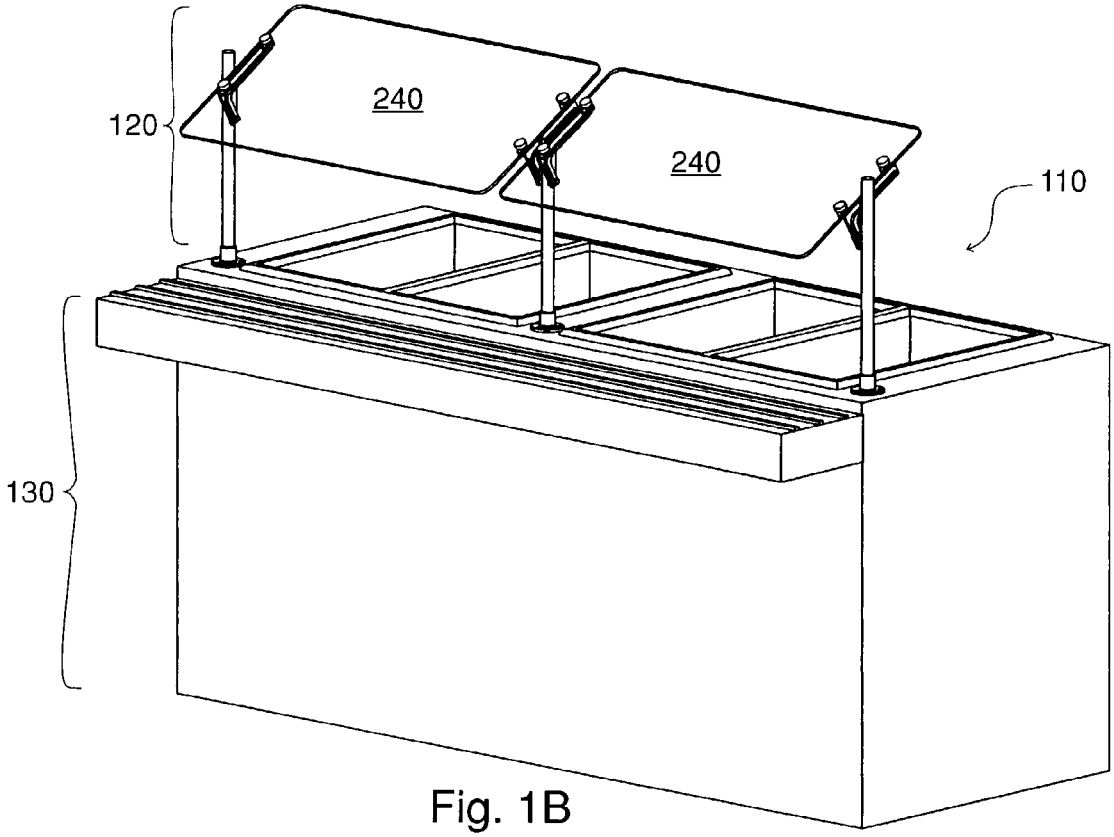

FIGS. 1A and 1B illustrate a perspective of an embodiment of the present invention. As shown, FIG. 1A illustrates a food service station 110 that has an adjustable, modular food guard 120 including a shield 240, and a food-serving device 130. All embodiments of the modular food guard 120 are not necessarily adjustable, as will be discussed later. As can be seen, the food guard 120 is in the vertical position, or an attendant-serving position, and substantially precludes customers from accessing food on the food service station 110. In addition, the modular food guard 120 substantially precludes bacteria and other contaminants originating from the breath of the customer from impinging upon the food by providing a barrier between the customer and the food. The customer can see the food and/or food preparation and can be handed the requested food from over the food guard 120 or under the food guard 120, if there is enough clearance between the food guard 120 and food serving device 130.

FIG. 1B illustrates a complete food service station 110 that has the modular food guard 120 in an angled position, or self-serving position, with respect to the food serving device 130. The embodiment of the present invention provides for an apparatus and method of moving the modular food guard 120 from the vertical position to an angled position. In this configuration, the customer can access the food and self-serve food from the food service station 110. The food guard 120 still substantially precludes bacteria and other contaminants originating from the customer from impinging upon the food by providing a barrier between the customer and the food. More specifically, the customer can see the food through the food guard 120, but the food guard 120 still provides a barrier between the breath of the customer and the food.

Figure 2:
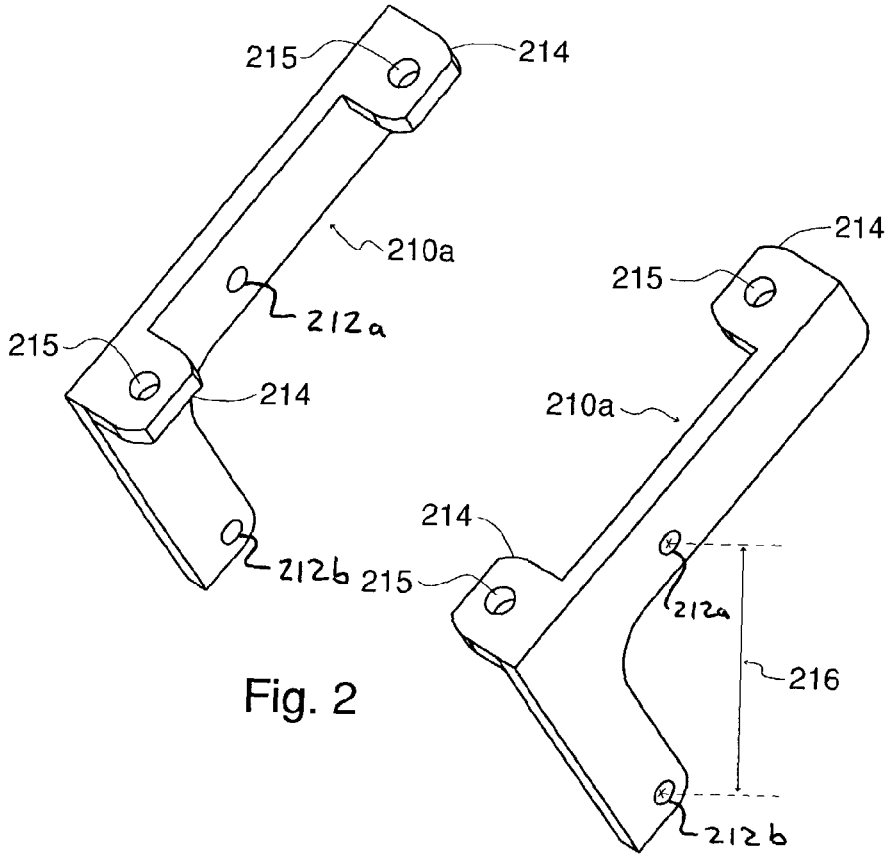
FIG. 2 illustrates a perspective view of an embodiment of interchangeable brackets for use with a modular food guard.
Figure 8:
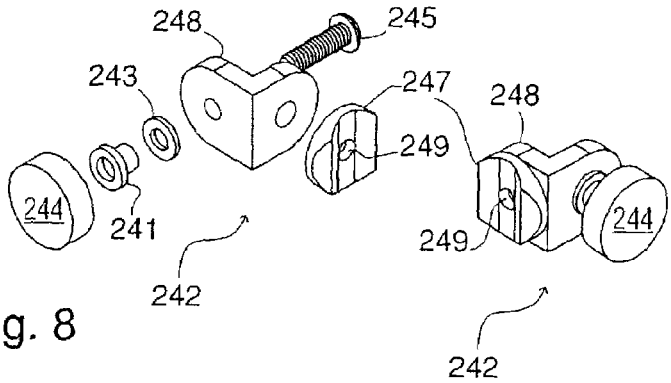
FIG. 8 illustrates a perspective, partially exploded view of an embodiment of shield cap assemblies for use with a modular food guard.

Individual elements of a preferred embodiment of a modular food guard 120 will now be discussed. FIG. 2 shows a pair of modular brackets 210*a*. Preferably, each modular bracket 210*a* includes a pair of support apertures 212*a*, 212*b* and a pair of support flanges 214. A predetermined distance 216, as measured from the centers of the support apertures 212*a*, 212*b* separates the support apertures 212*a*, 212*b*. The support flanges 214 are configured to support a shield 240 (FIGS. 1A–1B). As shown, each support flange 214 includes an orifice 215 configured to receive a threaded stem 245 and a shield cap 244 (FIG. 8). Preferably, a shield cap 244 includes a threaded orifice (not shown) configured to receive a threaded stem 245, such as a screw or bolt. However, embodiments are envisioned wherein the orifices 215 of each support flange 214 are threaded in order to matingly engage the threaded stem 245. Note, the support flanges 214 are only preferable embodiments, and other means are envisioned for attaching the shield 240 to the modular brackets 210, such as, but not limited to, adhesives, support grooves, etc. Note also, as will become apparent, embodiments are envisioned including numerous support apertures. For the purposes of the present application, modular brackets 210 that are mirror images of one another are considered to be of identical construction and are typically used in pairs.

Figure 3:
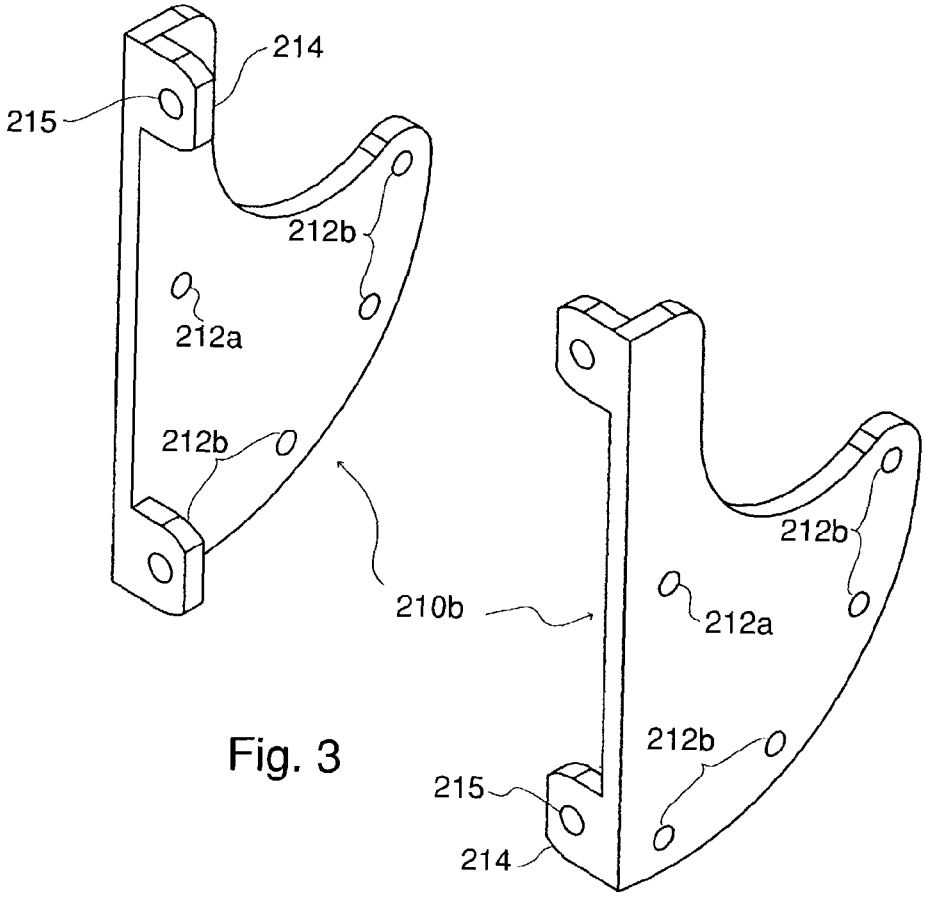
FIG. 3 illustrates a perspective view of an embodiment of interchangeable brackets for use with a modular food guard.

FIG. 3 shows a pair of modular brackets 210*b* that are adjustable between four positions relative to a vertical-mounting member 230 (FIG. 8). As shown, modular bracket

210*b* includes five support apertures 212*a*, 212*b*, with one support aperture 212*a* serving as a pivot point about which the modular bracket 210*b* can be rotated and four support apertures 212*b* that can be used to secure the modular bracket 210*b* in the desired position, as discussed hereinafter with regard to FIGS. 10A–10D. Each of the support apertures 212*b* is equidistant from support aperture 212*a*, that distance being equal to the pre-determined distance 216 between the support apertures 212*a*–212*b* of modular bracket 210*a* (FIG. 2). Similar to modular bracket 210*a*, modular bracket 210*b* is configured to receive a shield 240 (FIGS. 1A–1B).

Figure 4:
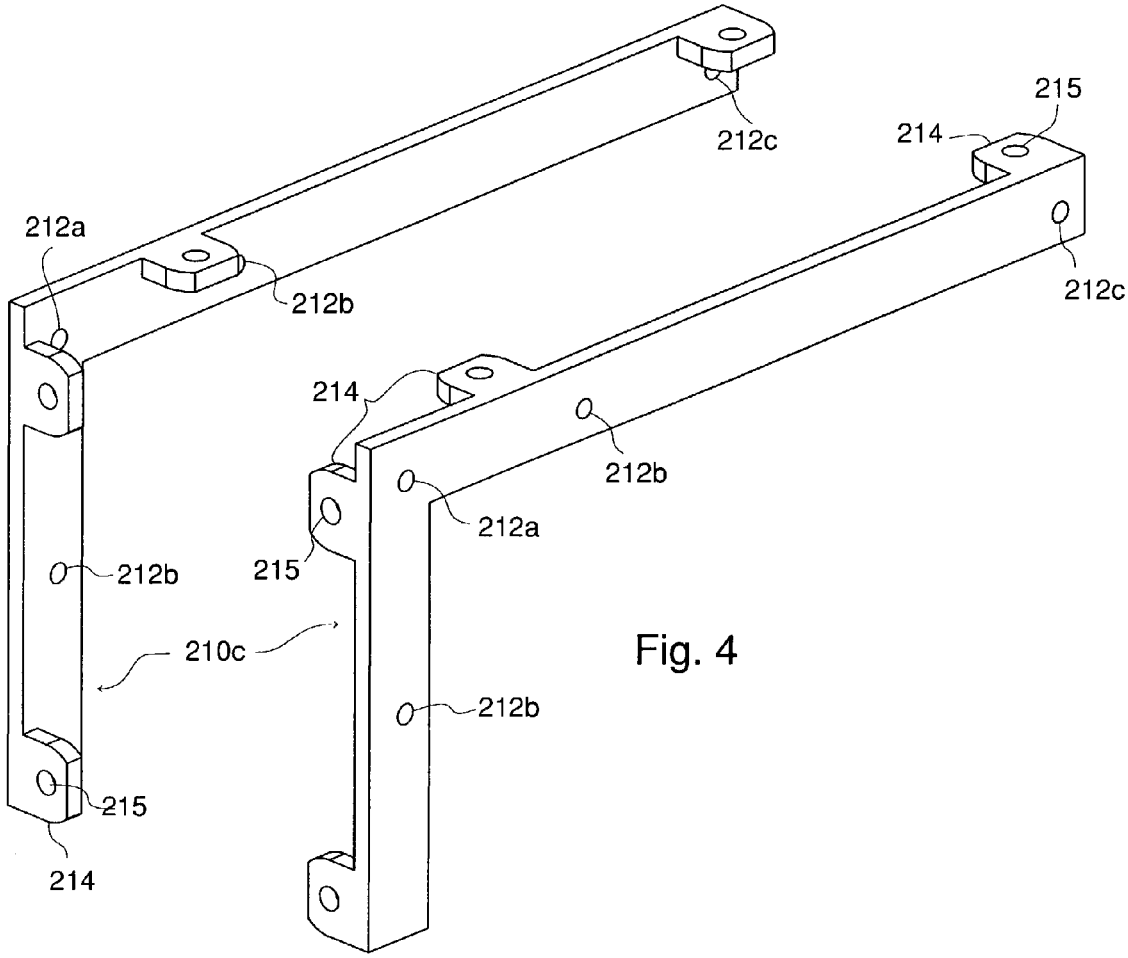
FIG. 4 illustrates a perspective view of an embodiment of interchangeable brackets for use with a modular food guard.
Figure 15:
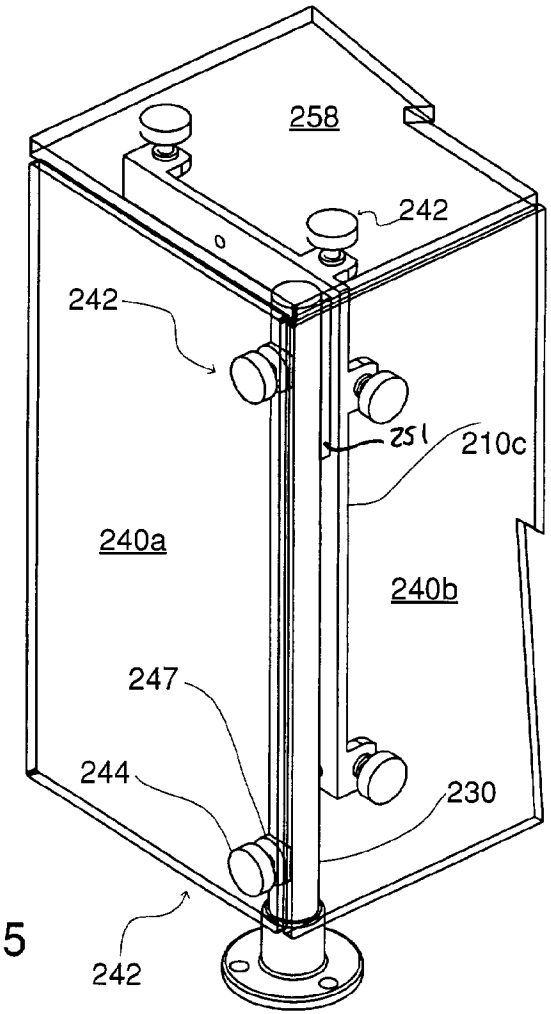
FIG. 15 illustrates a partial, perspective view of an embodiment of a modular food guard.

FIG. 4 shows a pair of modular brackets 210c that are adjustable between at least two positions relative to a vertical-mounting member 230 (FIG. 8). As shown, each modular bracket 210*c* includes four support apertures 212*s*, 212*b*, 212*c* and 212*d*, with one support aperture 212*a* serving as a pivot point about which modular bracket 210*c* can be rotated and three support apertures 212*b* and 212*c* that can be used to secure modular bracket 210*c* in a desired position. Each of the support apertures 212*b* is equidistant from support aperture 212*a*, that distance being equal to the pre-determined distance 216 between the support apertures 212*a*, 212*b* of modular brackets 210*a* (FIG. 2) and 210*b* (FIG. 3). Support aperture 212*c* is separated from support aperture 212*a* by a distance equal to an integer multiple of pre-determined distance 216. As well, modular bracket 210*c* is configured to receive a pair of shields 240 (as shown in FIG. 15), the shields 240 being supported substantially perpendicular to each other. Note, however, embodiments are envisioned wherein multiple shields are supported over a wide range of angles relative to each other.

Figure 5:
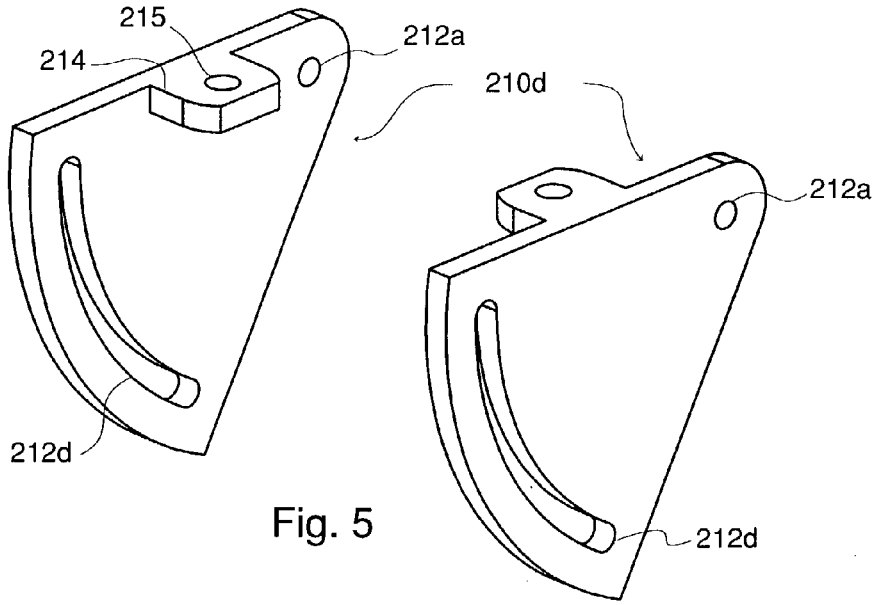
FIG. 5 illustrates a perspective view of an embodiment of interchangeable brackets for use with a modular food guard.
Figure 9:
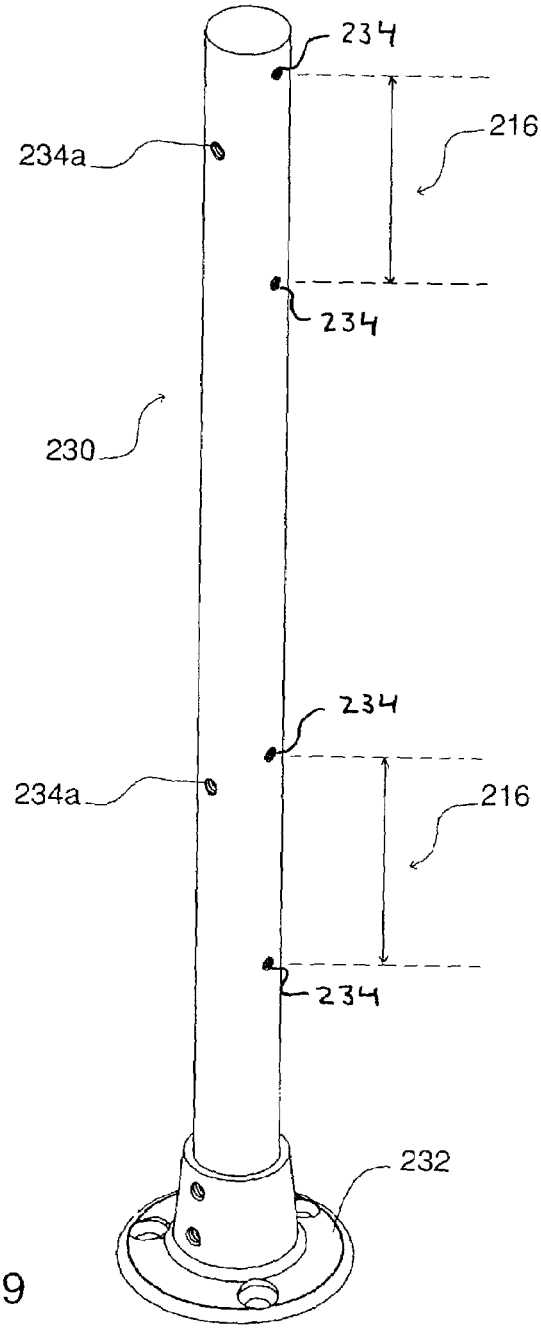
FIG. 9 illustrates a perspective view of an embodiment of a vertical mounting member for use with a modular food guard.

FIG. 5 shows a pair of modular brackets 210*d* that are adjustable over a wide range of positions relative to a vehicle mounting member 230 (FIG. 9). As shown, each modular bracket 210*d* includes two support apertures 212*a*, 212*d*, with one support aperture 212*a* serving as a pivot point about which modular bracket 210*d* can be rotated. Support aperture 212*d* can be used to secure modular bracket 210*d* in a desired position, as discussed hereinafter with regard to FIG. 12C. Support aperture 212*d* is configured as a slot, wherein each point along a central axis bisecting the slot is equidistant from support aperture 212*a*, that distance being equal to the pre-determined distance 216, such that support aperture 212*d* forms an arc about support aperture 212*a*.

Figure 6:
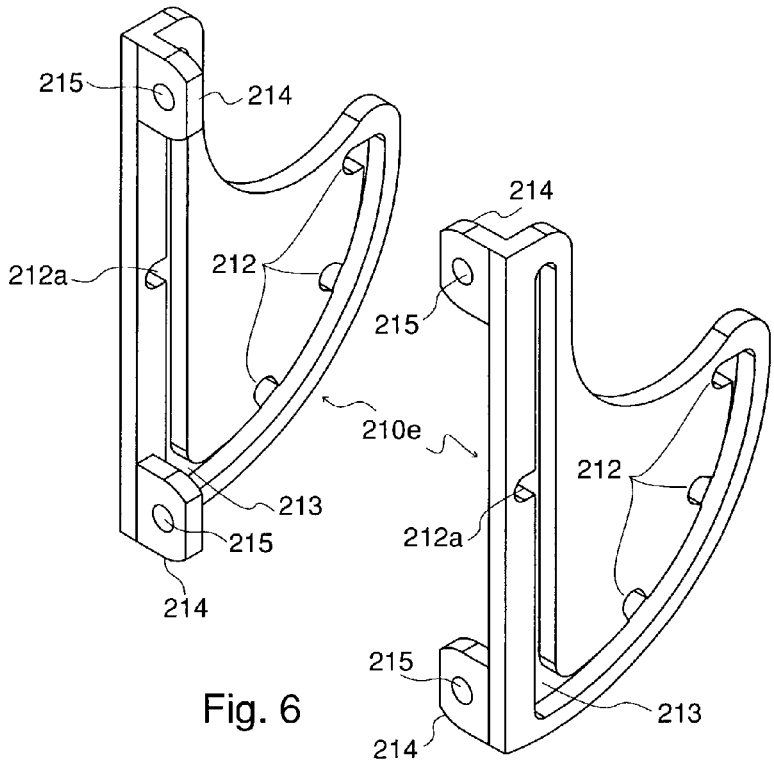
FIG. 6 illustrates a perspective view of an embodiment of interchangeable brackets for use with a modular food guard.

FIG. 6 shows a pair of modular brackets 210*e* that are adjustable between four positions relative to a vertical mounting member 230 (FIG. 9). As shown, each modular bracket 210*e* includes five support apertures 212*a*, 212*b* connected by a bracket channel 213. Support aperture 212*a* engages an upper pivot pin 235 while support aperture 212*b* engages a lower pivot pin 235, thereby determining the angle of the modular bracket 210*e* in the desired position, as discussed hereinafter with regard to FIGS. 11A–11D. Each of the support apertures 212*b* is equidistant from support aperture 212*a*, that distance being equal to the pre-determined distance 216 between the support apertures 212*a*, 212*b* of modular bracket 212*a* (FIG. 2). Similar to modular bracket 210*a*, modular bracket 210*e* is configured to receive a shield 240 (FIGS. 1A–1B).

Figure 7A:
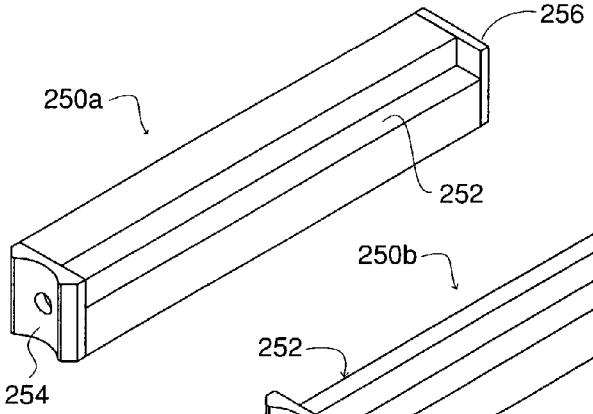
FIGS. 7A–7C illustrate perspective views of embodiments of shelf support members for use with a modular food guard.
Figure 7B:
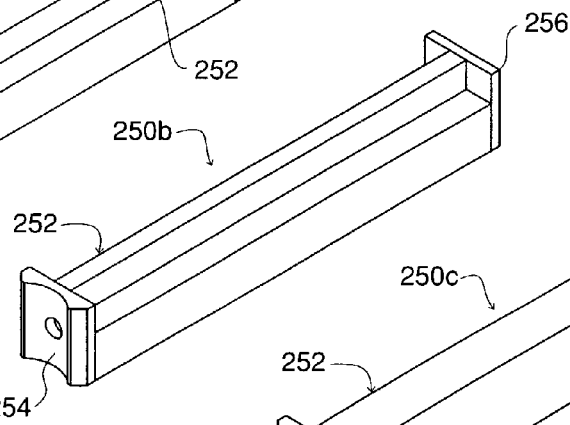
Figure 7C:
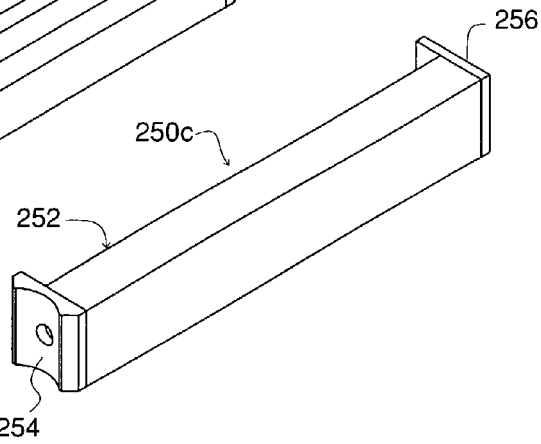
Figure 13A:
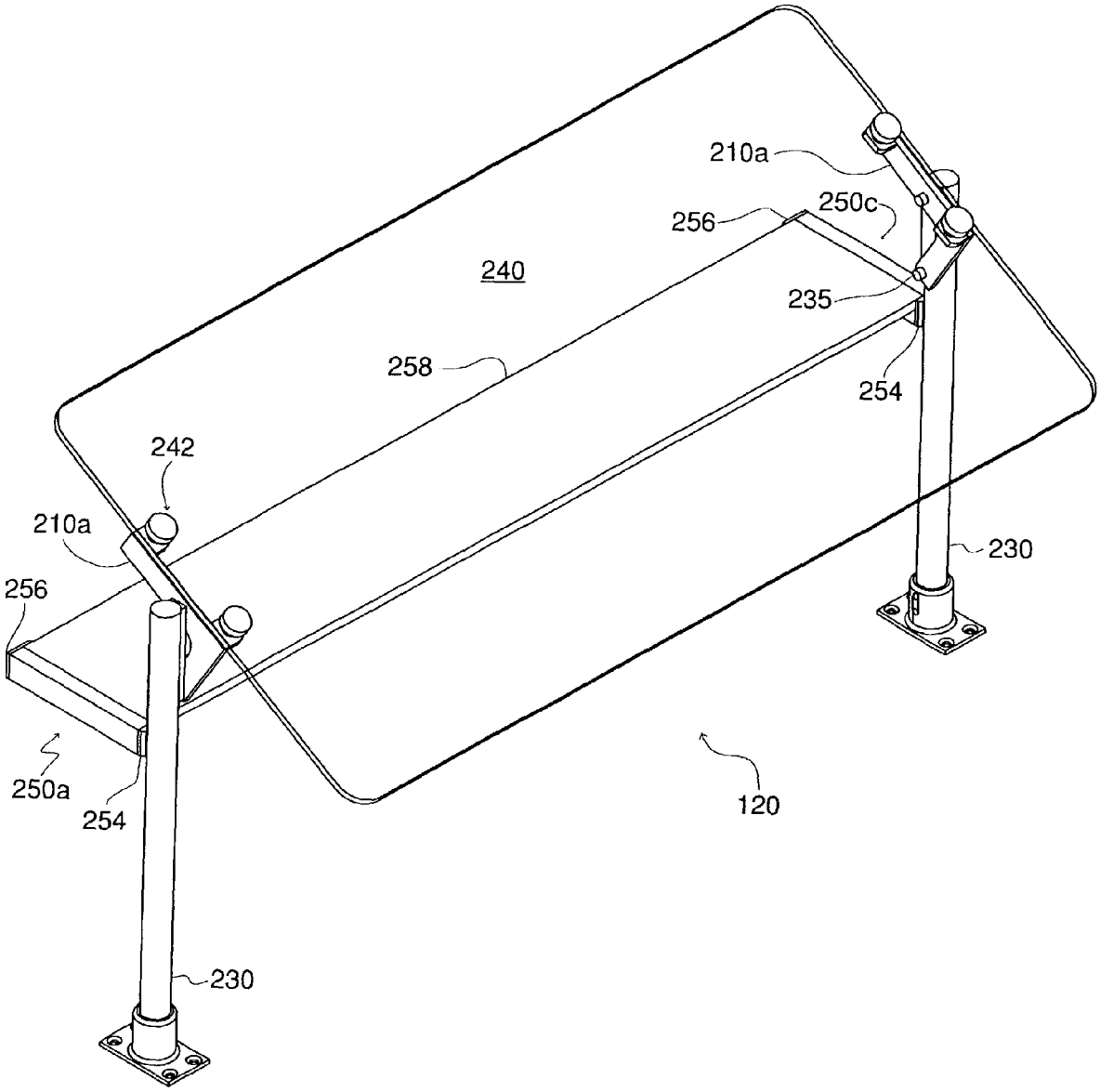
FIGS. 13A illustrates a perspective view of an embodiment of a modular food guard.

FIGS. 7A–7C show preferred embodiments of shelf support members 250*a*–250*c*, respectively, configured for use with preferred embodiments of the modular food guard 120. As shown, the left shelf support member 250*a* and the right shelf support member 250*c* each includes a shelf support groove 252, a front-end cap 254, and a rear end cap 256. Preferably, the front-end cap 254 is configured such that is conforms closely to the surface of the vertical mounting member 230 (FIG. 9) to which it is attached. As shown, the concave shape of the front-end cap 254 helps ensure the shelf support members can be securely mounted to the associated vertical mounting member 230, which preferably has a circular cross section. The rear end cap 256 helps to maintain a shelf 258 (FIG. 13A) in its associated shelf support groove 252 by preventing rearward motion of the shelf 258 (FIG. 13A). The center shelf support member 250*b* includes a pair of shelf support grooves 252, thereby enabling the center shelf support member 250*b* to support a pair of shelves 258, one disposed on each side of the center shelf support member 250*b*. Preferably, the shelf support members are removably connected to the vertical mounting member 230 using threaded fasteners (not shown).

FIG. 8 shows a preferred embodiment of a pair of shield cap assembly 242 including a shield cap 244, a threaded stem 245, a coped connector 247, and an angled flange 248 having a pair of mounting apertures 249. One of the mounting apertures 249 is utilized for mounting the angled flange 248 to a vertical mounting member 230 (FIG. 9) while the other is utilized for attaching a shield 240 (FIGS. 1A–1B) to the angled flange 248. Preferably, an insulator 241 and a washer 243 are used to prevent the shield cap 244 and threaded stem 245 from directly contacting the shield 240, thereby preventing potential damage to the shield 240. Preferably, threaded fasteners (not shown) are used to attach the angled flange 248 to the vertical mounting member 230. Note the coped connector 247 can be placed between the angled flange 248 and the vertical mounting member 230 to ensure a stable mounting exists. As well, the angled flange 248 can be rotated such that the shield 240 is supported in a substantially vertical plane, or such that the shield 240 is supported in a substantially horizontal plane (FIG. 14) and thereby functions as a shelf.

Figure 13B:
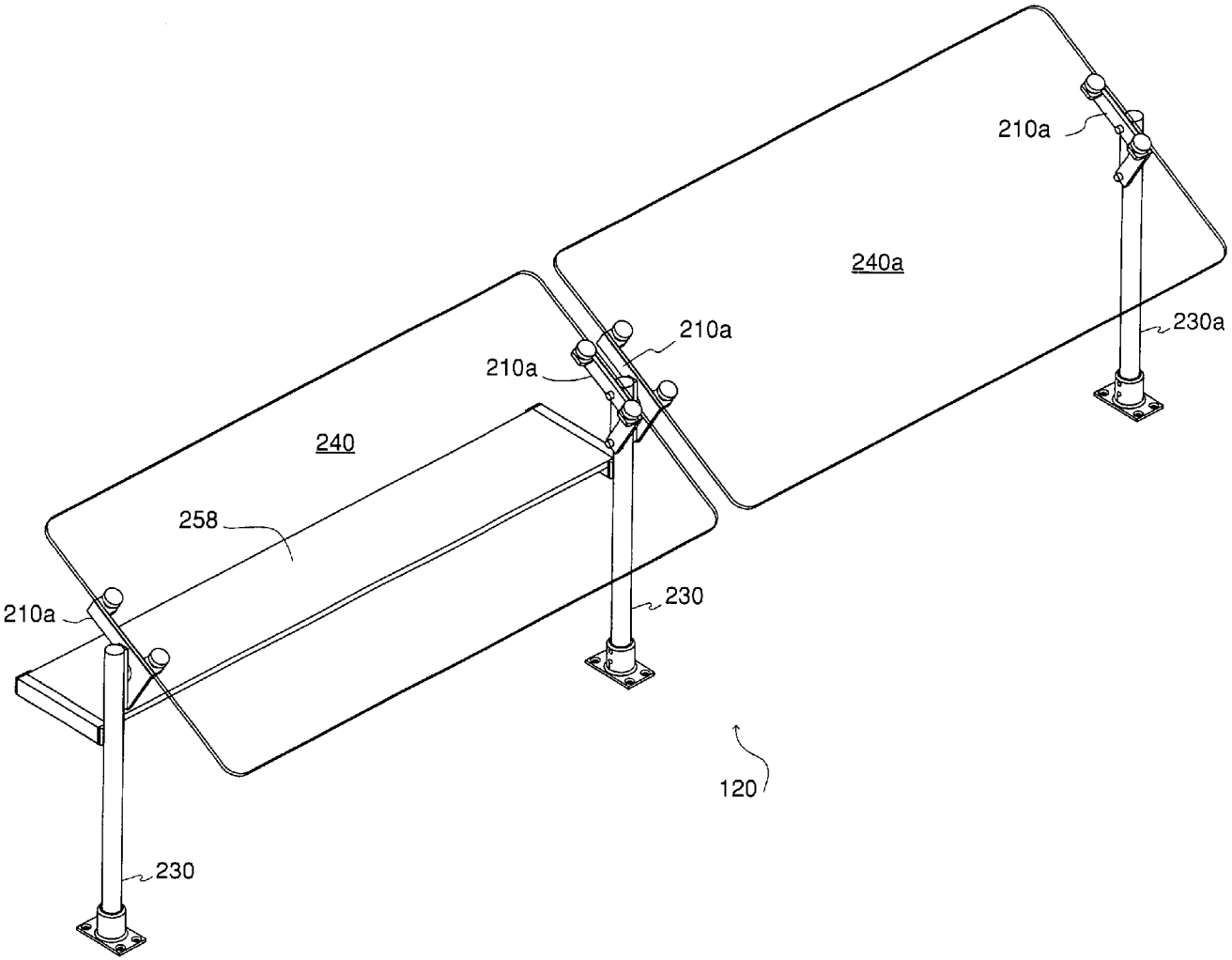
FIG. 13B illustrates a perspective view of the modular food guard shown in FIG. 13A with an additional segment removably attached thereto.

FIG. 9 is a perspective view of a preferred embodiment of a vertical mounting member 230 for use with a preferred embodiment of the modular food guard 120. The vertical mounting member 230 includes a base 232 and a plurality of support receptacles 234. As shown, two pairs of support receptacles 234 are disposed on a first side of the vertical mounting member 230, and the support receptacles 234 within each pair are separated by the pre-determined distance 216 separating corresponding support apertures on modular brackets 210*a*–210*e* (FIGS. 2–6, respectively). As such, modular brackets 210*a*–210*e* may all be interchangeably attached to the vertical mounting member 230, preferably with threaded fasteners, such as pivot pins 235. As well, the vertical mounting member 230 includes a number of individual support receptacles 234*a* positioned to receive shelf support members 250*a*–*c* (FIGS. 7A–7C). Preferably, the vertical mounting member 230 includes at least a pair of support receptacles 234 on a second side (not shown), typically opposite the first side, such that modular brackets 210*a*–210*e* can be supported opposite each other (FIG. 13B). Preferably, the support receptacles 234 can be used to secure shields 240 directly to the vertical mounting members 230 using threaded fasteners, such as shield caps 244 (as shown in FIG. 15). Embodiments are envisioned wherein the vertical mounting members 230 have other than circular cross sections, such as square, rectangular, etc.

FIGS. 10A–10D illustrate a perspective view of an embodiment of the present invention. FIGS. 10A–10D illustrate the movement of the various parts of an adjustable four-position modular food guard 120. The modular food guard 120 includes a pair of modular brackets 210*b* (FIG. 3), a vertical-mounting member 230, and a shield 240. The shield 240 is attached to the modular bracket 210*b* via a plurality of shield cap assemblies 242, minus the angled flange 248. The modular bracket 210*b* engages the vertical-mounting member 230 by way of a plurality of pivot pins 235. More specifically, the pivot pins 235 engage the modular bracket 210*b* through one or more support apertures 212. The pivot pins 235 are attached to the vertical-mounting member 230 by engaging support receptacles 234 (FIG. 9) that correspond to the support apertures 212. As shown, the modular bracket 210*b* includes four support apertures 212*b* that can be used to secure the shield at angles of approximately zero degrees, thirty degrees, sixty degrees, and ninety degrees relative to the vertical mounting member 230. The angle is changed by removing the pivot pin 235 disposed through one of the support apertures 212*b*, rotating the shield 240 into the desired position such that a support aperture 212*b* is aligned with a support receptacle 234, and re-engaging the support receptacle 234 with the pivot pin 235.

Figure 10A:
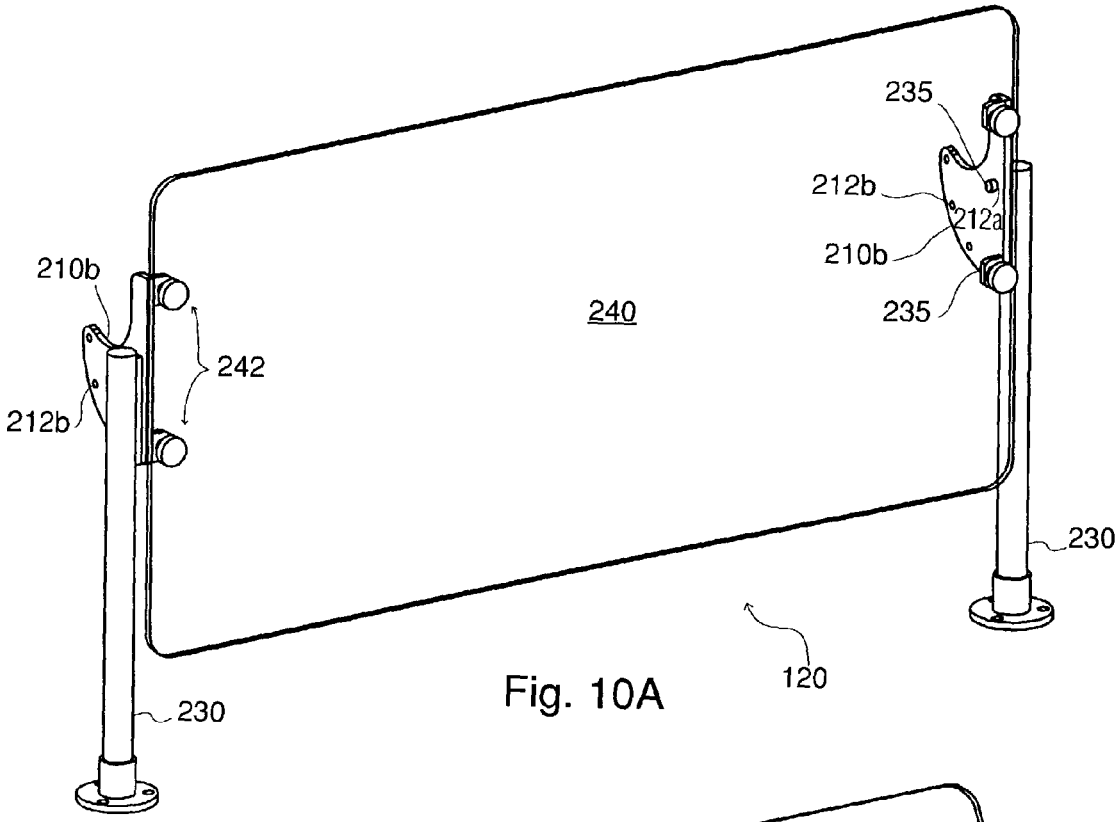
FIGS. 10A–10D illustrates perspective views of an embodiment of a modular food guard adjusted to various positions.
Figure 10B:
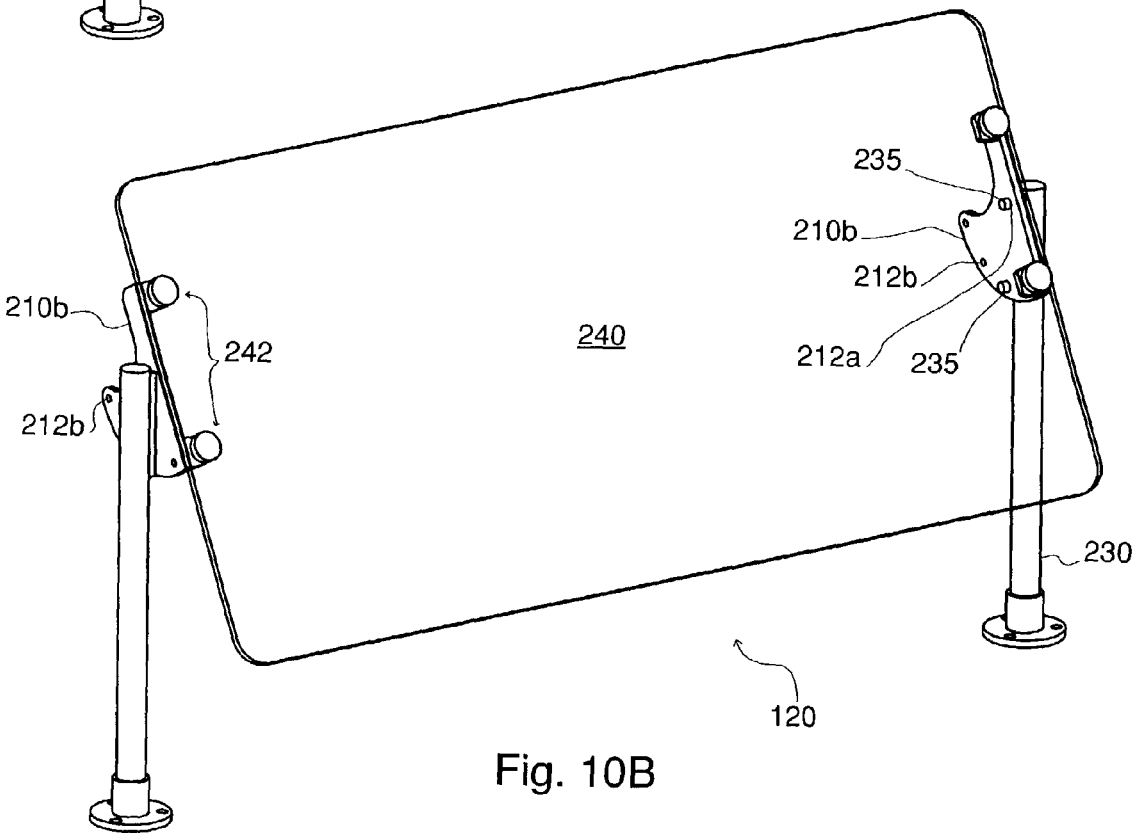
Figure 10C:
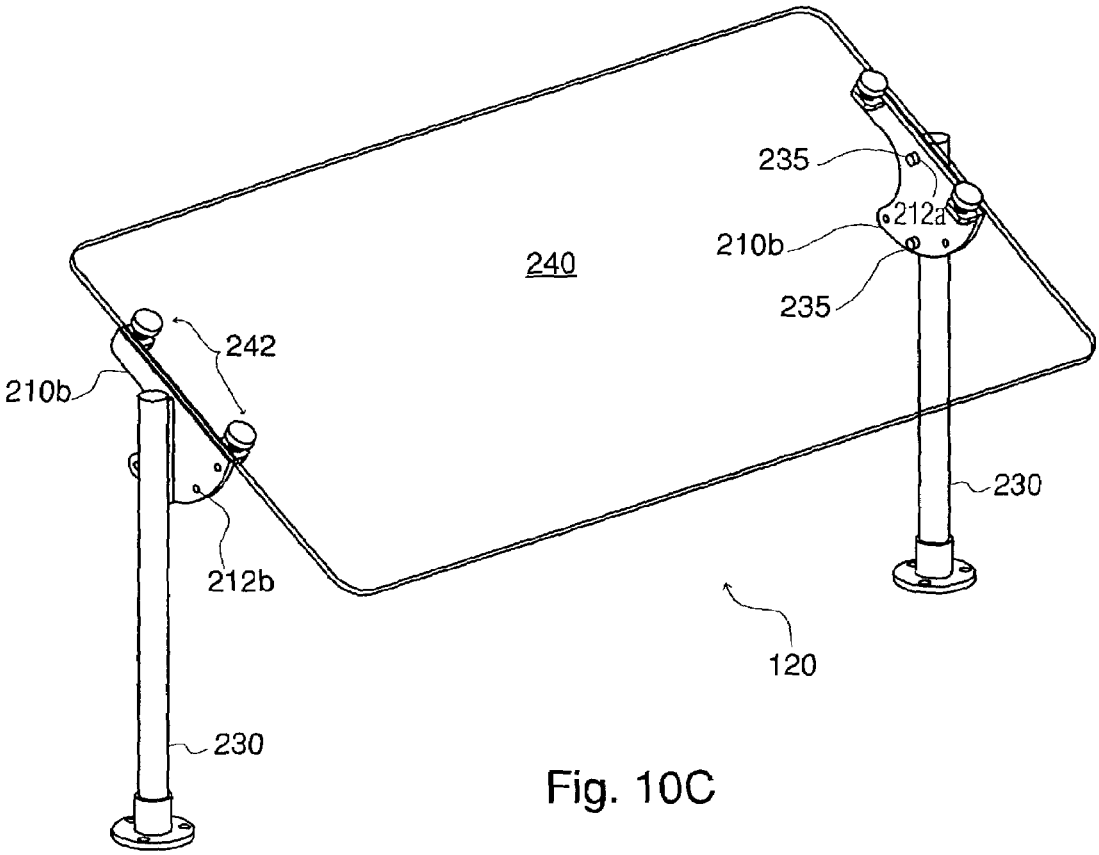
Figure 10D:
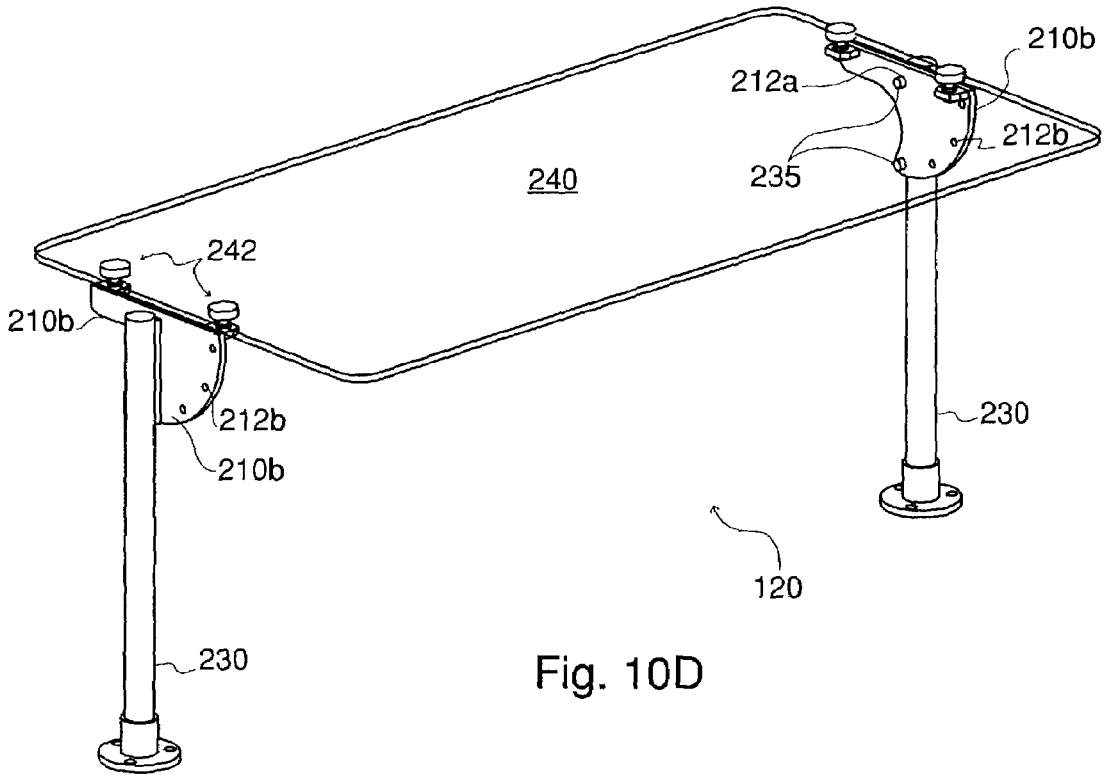

FIGS. 10B and 10C illustrate the modular food guard 120 after it has been moved into one of the intermediate positions. The angle chosen will depend upon the function the shield 240 will serve. To re-position the shelf 240 from the vertical position (FIG. 10A), the lower pivot pin 235 is removed from the associated support receptacle 234 and support aperture 212*b*. The shield 240 is then rotated into the desired position such that one of the support apertures 212*b* on each modular bracket 210*b* is aligned with a support receptacle 234. Once in the desired position, the pivot pin 235 is passed through the support aperture 234 and inserted into the support receptacle 234. FIG. 10D shows the shield 240 in the position at which the shield 240 is perpendicular to the vertical mounting member 230. In this position, the shield 240 can function as a shelf.

Figure 11A:
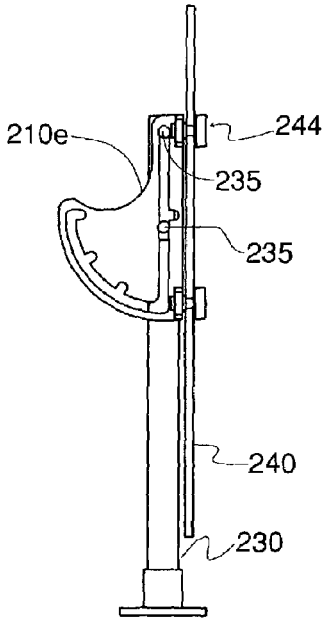
FIGS. 11A–11D illustrate cut out side views of an embodiment of a modular food guard adjusted to various positions.

FIGS. 11A–11D illustrate a cut out view of an embodiment of the present invention. FIGS. 11A–11D illustrate the movement of the various parts of modular four-position food guard 120. The modular food guard 120 includes a modular bracket 210*e*, a vertical-mounting member 230, and a shield 240. The shield 240 is attached to the adjustable bracket 210*e* via a plurality of shield cap assemblies 242, without the angled brackets 248. The modular bracket 210*e* engages the vertical-mounting member 230 by way of a plurality of pivot pins 235. More specifically, the pivot pins 235 engage the adjustable bracket 210*e* through a bracket channel 213. The pivot pins 235 are attached to the vertical-mounting member 230 through the bracket channel 213. In a preferred embodiment, the bracket channel 213 connects four support apertures 212*a*, 212*b* that can be engaged with the pivot pins 235. In a preferred embodiment, support apertures 212*b* are at angles of about thirty, sixty, and ninety degrees from the substantially straight portion of the bracket channel 213. FIG. 11A shows modular bracket 210*e* in the vertical position, wherein none of the support apertures 212*a*, 212*b* are engaged by the pivot pins 235. The adjustable bracket 210*e* can slide along the pivot pins 235 into the desired position and locked into position by the support apertures 212*a*, 212*b*.

Figure 11B:
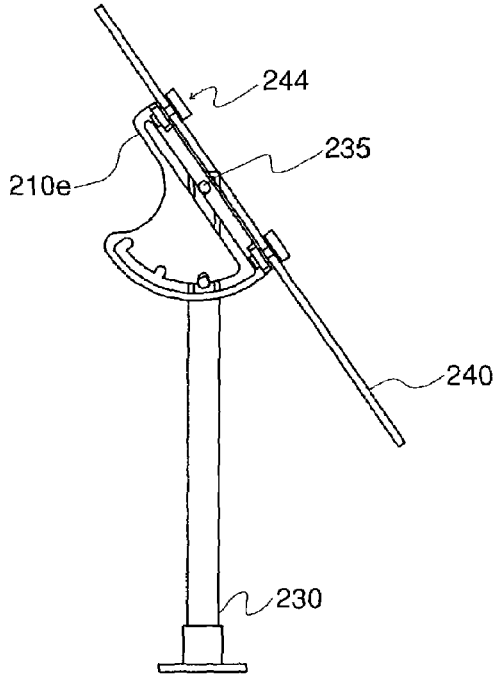
Figure 11C:
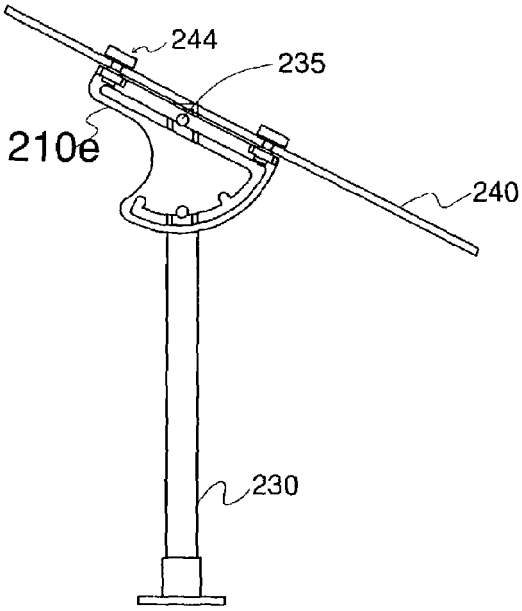
Figure 11D:
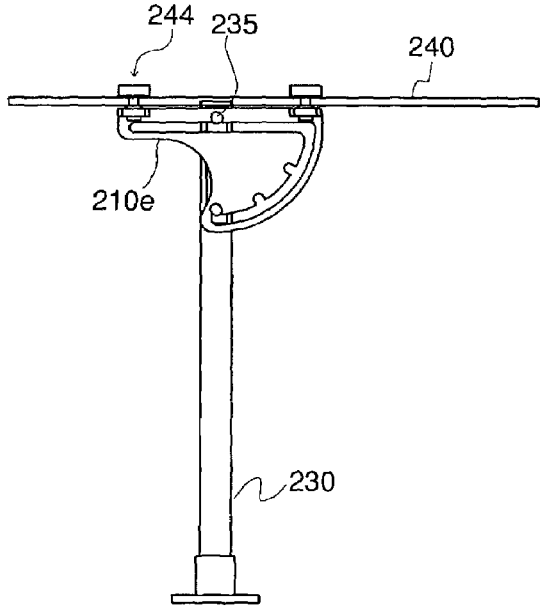

FIG. 11B illustrates the modular bracket 210*a* after it has been moved into a locked position of approximately thirty degrees relative to the vertical support member 230 using support apertures 212*a*, 212*b*. More specifically, the modular bracket 210*e* slides along the pivot pins 235, where the pivot pins 235 are engaged to the adjustable bracket 210*e* through the support apertures 212*a*, 212*b*. The modular bracket 210*e* slides into a position such that an upper pivot pin 235 engages support aperture 212*a* and a lower pivot pin engages one of support apertures 212*b* so the shield 240 is in an angled position. A non-limiting illustrative example of the angle of the shield 240 (depicted in FIG. 11B) is about thirty degrees, but any other appropriate angle could be used. The support apertures 212*a*, 212*b* can be disengaged from the pivot pins 235 and the shield 240 slide back into the vertical position, as depicted in FIG. 11A, or into another angled position, as depicted in FIG. 11C (sixty degrees) and 11D (ninety degrees).

Figure 12A:
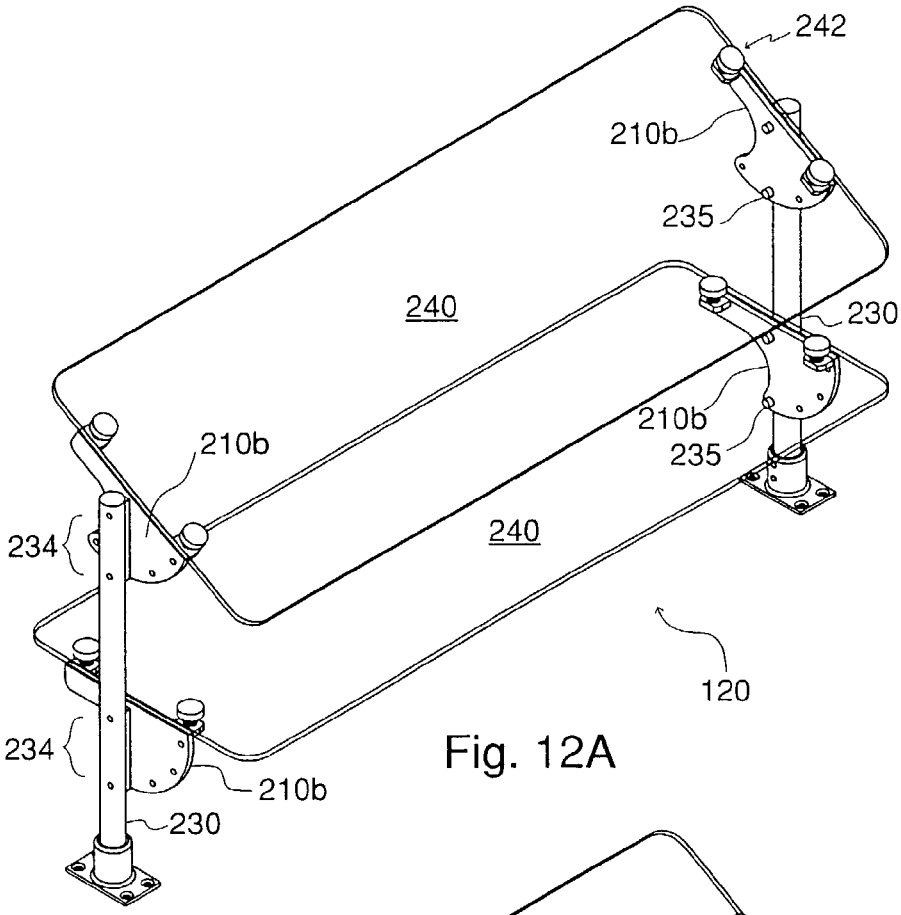
FIGS. 12A–12C illustrate perspective views of embodiments of modular food guards having various combinations of interchangeable brackets.
Figure 12B:
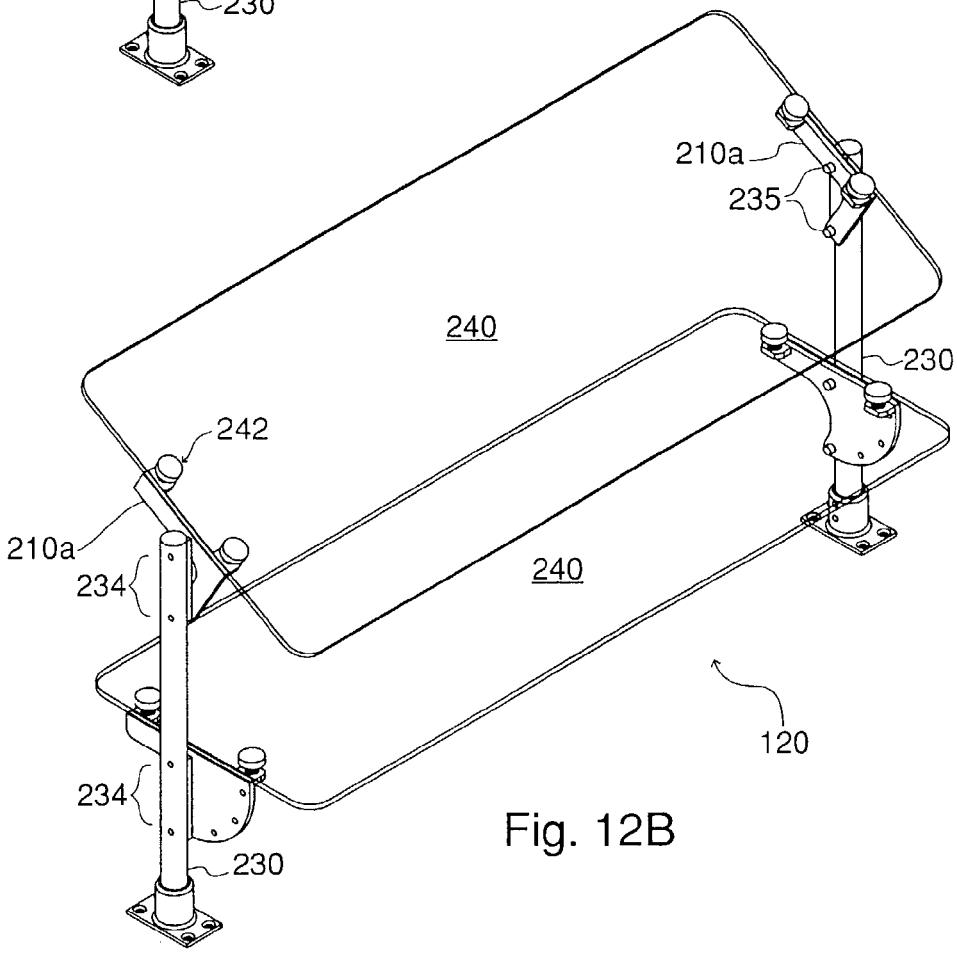
Figure 12C:
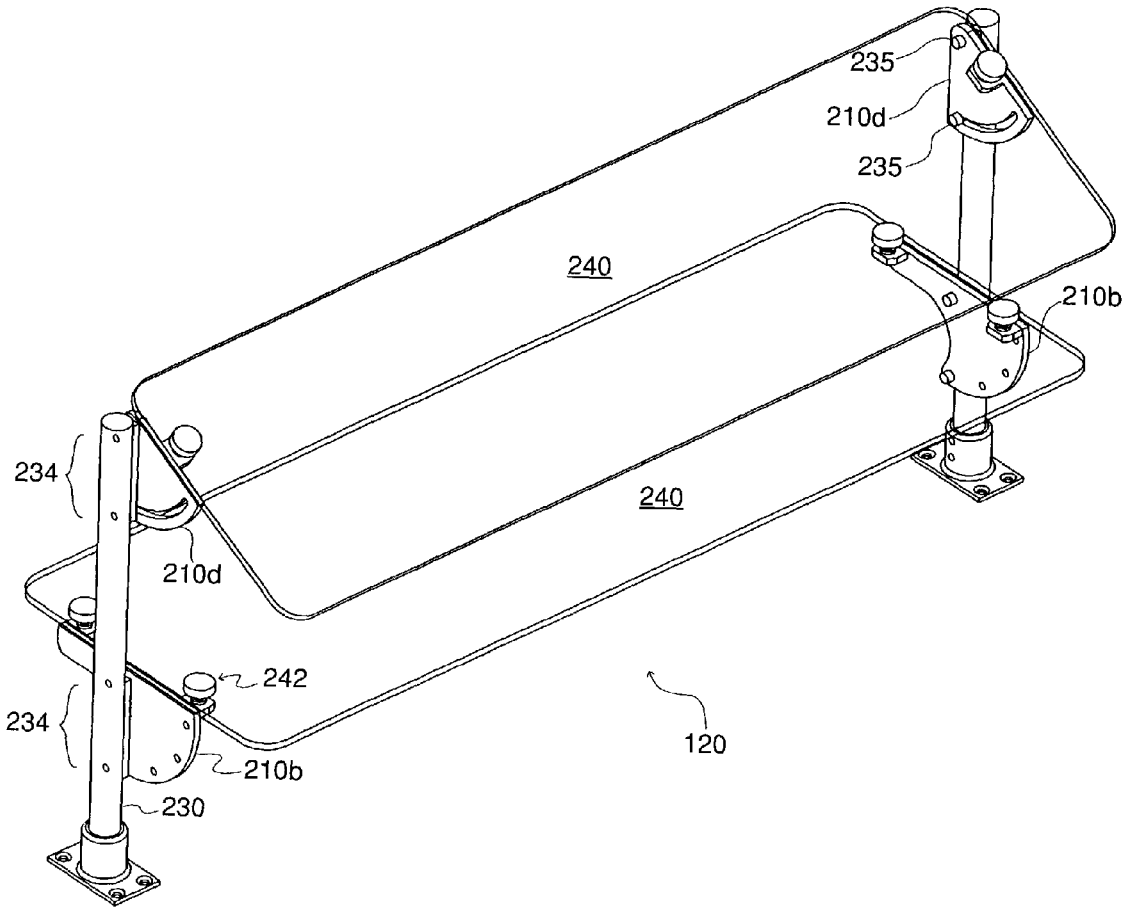

FIGS. 12A–12C illustrate embodiments of the modular food guard 120 wherein each vertical mounting member 230 is configured to support multiple modular brackets 210 and/or shields 240. More specifically, multiple pairs of support receptacles 234 are disposed on the vertical mounting members 230, further increasing the flexibility and ease with which the modular food guard 120 can be modified. FIG. 12A shows two shields 240 attached to the vertical mounting members 230 with adjustable modular brackets 210*b*, as discussed with regard to FIGS. 10A–10D. As such, both shields 240 can be secured in a number of different positions. As shown, the lower shield 240 functions as a shelf and the upper shield 240 functions as a "sneeze guard" for items placed on the lower shield 240. The modular food guard 120 could be easily modified into a two-shelf configuration (not shown) by adjusting the upper shield 240 as discussed above with regard to FIG. 9D. Extra pairs of support receptacles 234 disposed on the vertical mounting members 230 opposite the modular brackets 210*b* permit the modular food guard 120 to be expanded laterally with the addition of extra modular brackets 210, shields 240, etc.

FIG. 12B illustrates a similar embodiment of the modular food guard 120 to that shown in FIG. 12A, with the exception of replacing the upper pair of modular brackets 210*b* (FIG. 3) with the modular brackets 210*a* (FIG. 2). The modular brackets 210*a* and 210*b* are interchangeable because a pre-determined distance 216, as discussed with regard to FIGS. 2 and 3, respectively, separates the support apertures 212*a*, 212*b* on both brackets. To interchange the modular brackets 210*a* and 210*b*, an operator first removes the upper shield 240. This is accomplished by removing the shield caps 244 that secure the shield 240 to the modular brackets 210*b*. Next, the modular brackets 210*b* are removed by disengaging the pivot pins 235 from the support receptacles 234. To install the modular brackets 210*a*, the support apertures 212*a*, 212*b* are aligned with the support receptacles 234 and the pivot pins 235 are disposed through the support apertures 212*a*, 212*b* and engage the support receptacles 234. The shield 240 is attached to the modular brackets 210*a* with the shield caps assemblies 242. Note, however, because modular bracket 210*a* has only two support apertures, it is not adjustable.

FIG. 12C illustrates a similar embodiment of the modular food guard 120 to that shown in FIGS. 12A and 12B, with the exception of replacing the upper pair of modular brackets 210*b* and 210*a*, respectively, with the modular brackets 210*d* (FIG. 5). The modular brackets 210*d* are installed as discussed with regard to FIGS. 12A and 12B. However, the modular brackets 210*d* include a slot-shaped support aperture 212*d*, as discussed with regard to FIG. 5, and are therefore adjustable. To adjust the upper shield 240, the pivot pin 235 disposed in the slot-shaped support aperture 212*d* is loosened such that the modular bracket 210*d* is free to rotate about the pivot pins 235 disposed in support apertures 212*a*. Once the shield 240 is in the desired position, the loosened pivot pins 235 are re-tightened such that they engage the slot-shaped support aperture 212*d*. Note, the slot-shaped support aperture 212*d* can be engaged by the pivot pins 235 at any point along its length, meaning the shield 240 can be secured in a large number of positions.

FIG. 13A illustrates a perspective view of an embodiment of the present invention. The modular food guard 120 includes a pair of modular brackets 210*a* (FIG. 2), a pair of vertical mounting members 230, a shield 240, a pair of shelf support members 250*a*, 250*b*, and a shelf 258. Each shelf support member 250*a*, 250*b* includes a front-end cap 254, a rear end cap 256, and a shelf support groove 252, as discussed with regard to FIGS. 7A–7C. The shelf support member 250*a*, 250*b* can be of unitary construction, but preferably, the noted elements are separate and connected by threaded fasteners (not shown). Preferably, the shelf support members 250*a*, 250*b* are attached to an associated vertical mounting member 230 by disposing a threaded fastener through an orifice in the front end cap 254 and engaging a support receptacle 234 disposed on the vertical mounting member 230. After securing the shelf support members 250*a*, 250*b* to their respective vertical mounting members 230, opposing ends of the shelf 258 are disposed in opposing shelf support grooves 252 on the shelf support members 250*a*, 250*b*. Rearward motion of the shelf 258 within the shelf support grooves 252 is then prevented by threadably securing a rear end cap 256 to each shelf support member 250*a*, 250*b*.

FIG. 13B illustrates the embodiment of the modular food guard 120 as shown in 13A, with the addition of a third vertical mounting member 230*a*, a pair of modular brackets 210*a*, and a second shield 240*a*.

Figure 14:
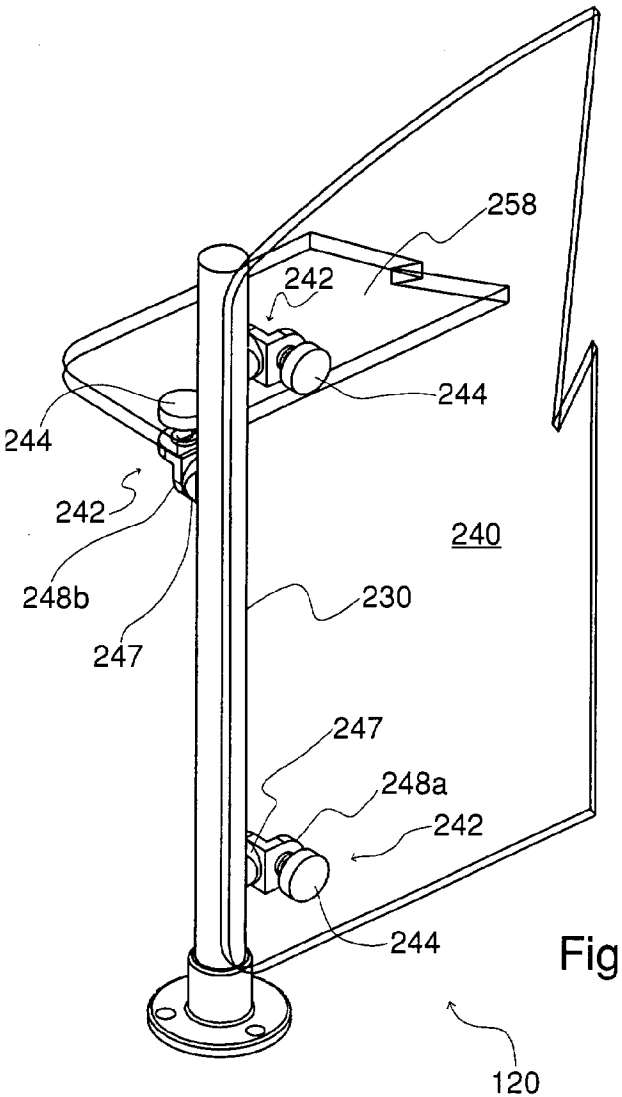
FIG. 14 illustrates a partial, perspective view of an embodiment of a modular food guard.

FIG. 14 illustrates a portion of an embodiment of a modular food guard 120 according to the present invention. As shown, the modular food guard 120 includes a vertical mounting member 230, a shield 240, a shelf 258, and a plurality of shield cap assemblies 242. Preferably, each shield cap assembly 242 includes a shield cap 244, a threaded stem 245 (FIG. 8), a coped connector 247, and an angled flange 248. As shown, the shield cap assembly 242 can be used to mount both shields 240 and shelves 258 to the vertical-mounting member 230. To mount a shield 240 to the vertical mounting member 230, apertures in the coped connector 247 and a first flange of the angled flange 248*a* are aligned with a support receptacle 234. A threaded fastener is then passed through the apertures and threadably engaged in the support receptacle 234. Prior to securing the angled flange 248*a* in the desired position, the operator should ensure the second flange of the angled flange 248*a* is substantially parallel to the plane of the shield 240. Next, apertures in both the second flange and the shield 240 are aligned so that the threaded steam 245 can be passed therethrough and threadably engaged with the shield cap 244.

To mount a shelf 250 to the vertical-mounting member 230, substantially the same procedure is followed as that discussed above with regard to mounting a shield 240, with one exception. Prior to securing the angled flange 248*b* to the vertical mounting member 230 with the threaded fastener, the angled flange 248*b* is rotated such that the second flange is in a substantially horizontal disposition.

FIG. 15 illustrates a portion of an embodiment of a modular food guard 120 according to the present invention. As shown, the modular food guard 120 includes a vertical mounting member 230, a modular bracket 210*c*, a shelf 258, and a pair of shields 240*a* and 240*b*. The side shield 240*a* is connected to the vertical-mounting member 230 using only the shield caps 244, a threaded stem 245 and coped connectors 247 of the shield cap assemblies 242. Preferably, the threads of the threaded fasteners, such as the pivot pins 235 and shield cap 244, are the same so that they can be used interchangeably with the support receptacles 234. Preferably, spacer element 251 is positioned between modular bracket 210*c* and vertical mounting member 230. The spacer element 251 includes a concave side adjacent the vertical mounting member 230 and a substantially flat side adjacent the modular bracket 210*c*. As such, the spacer element 251 allows the modular bracket 210*c* to be securely mounted to the vertical mounting member 230.

Figure 16:
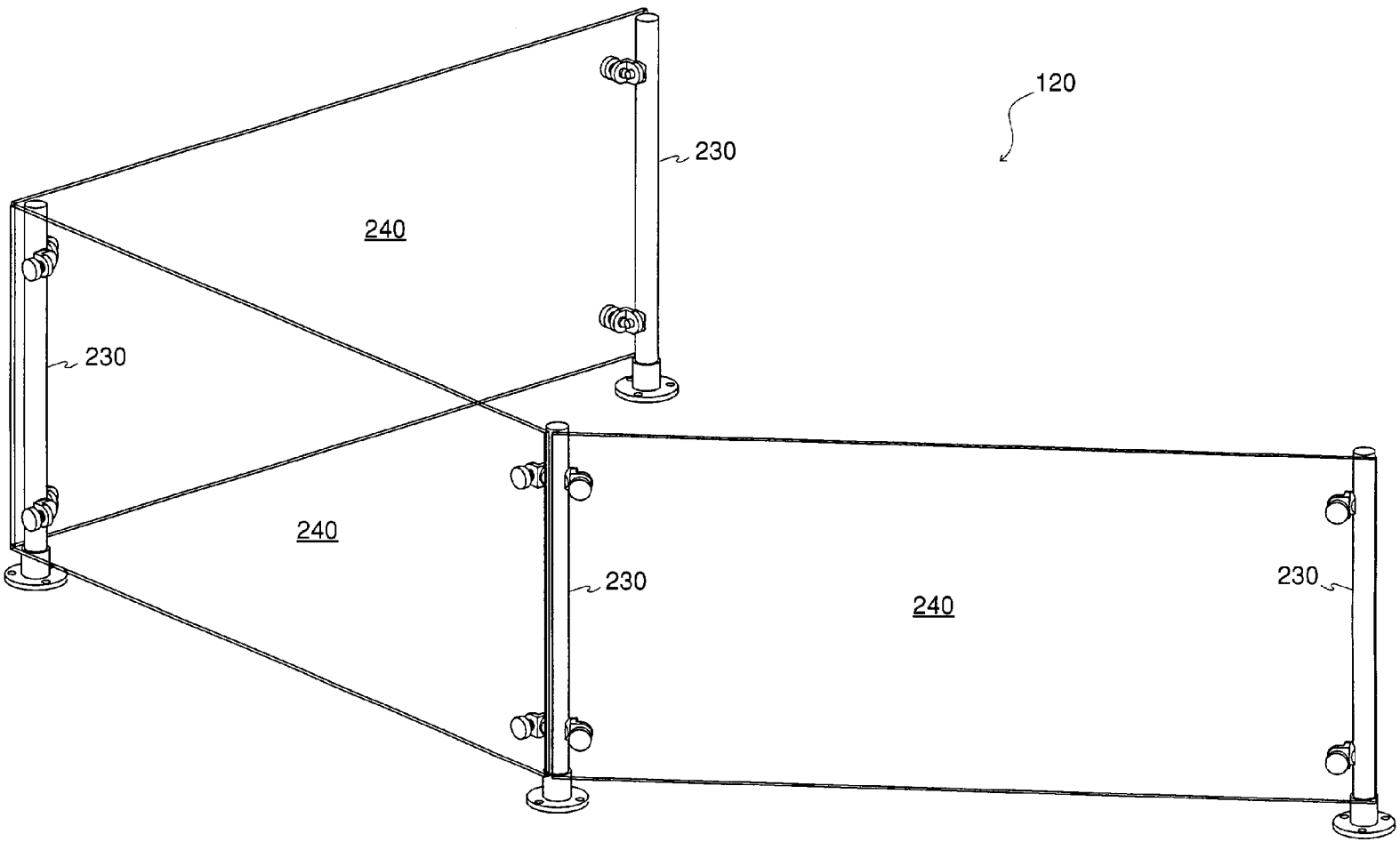
FIG. 16 illustrates a perspective view of an embodiment of a modular food guard.

FIG. 16 illustrates a modular food guard 120 according to the present invention. As shown, the modular food guard 120 includes a plurality of shields 240 attached to a plurality of vertical mounting members 230 using shield cap assemblies. Note that the shields 240 do not lie along a single plane. This is the result if disposing the support receptacles 234 on each vertical mounting member such that the support receptacles 234 are not disposed directly opposite each other. The angle between adjacent shields 240 can be chosen by the placement of the support receptacles 234 on the vertical-mounting members 230.

Although not shown, embodiments are envisioned wherein modular food guards 120 are mounted to vertical surfaces (i.e., walls). Also, embodiments are envisioned wherein modular food guards 120 extend downwardly from overhangs (i.e., ceilings).

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed:

1. A modular food guard apparatus, comprising:

at least one vertical mounting member;

at least one first bracket member;

at least one second bracket member, wherein the first and the second bracket members have different constructions and are arranged and configured to be removably secured to the at least one vertical mounting member interchangeably, and wherein at least one of the first bracket member and the second bracket member is configured in such a way that at least one of the first bracket member and the second bracket member can be disposed in a plurality of positions relative to the at least one vertical mounting member;

a plurality of pivot pins configured to engage a plurality of support receptacles disposed in the vertical mounting member; and a first support aperture and a second support aperture disposed in each of the first and the second bracket members, the first support aperture and the second support aperture being separated by a distance, wherein the first and the second bracket members are removably secured to the vertical mounting member by disposing the pivot pins through the first and the second support apertures and engaging the support receptacles; and wherein the second support aperture of the at least one first bracket member further comprises a plurality of second support apertures, each of the second support apertures being equidistant from the first support aperture such that the at least one first bracket member can be disposed in a plurality of positions relative to the at least one vertical mounting member.

2. The apparatus of claim 1, wherein the plurality of pivot pins and the plurality of support receptacles are matingly threaded.

3. The apparatus of claim 1, wherein the first bracket member and the second bracket member are further configured to removably receive a shield.

4. The apparatus of claim 1, wherein the at least one vertical mounting member further includes a first side and a second side, and the at least one vertical mounting member is configured such that the first and the second bracket members can be removably secured to the first side simultaneously.

5. The apparatus of claim 1, wherein the at least one vertical mounting member further includes a first side and a second side, and the at least one vertical mounting member is configured such that the first and the second bracket members can be removably secured to the first and the second sides, respectively, simultaneously.

6. A modular food guard apparatus, comprising:

at least one vertical mounting member;

at least one first bracket member;

at least one second bracket member, wherein the first and the second bracket members have different constructions and are arranged and configured to be removably secured to the at least one vertical mounting member interchangeably, and wherein at least one of the first bracket member and the second bracket member is configured in such a way that at least one of the first bracket member and the second bracket member can be disposed in a plurality of positions relative to the at least one vertical mounting member;

a plurality of pivot pins configured to engage a plurality of support receptacles disposed in the vertical mounting member; and a first support aperture and a second support aperture disposed in each of the first and the second bracket members, the first support aperture and the second support aperture being separated by a distance, wherein the first and the second bracket members are removably secured to the vertical mounting member by disposing the pivot pins through the first and the second support apertures and engaging the support receptacles; and wherein the second support aperture of the at least one first bracket member further comprises a support slot configured such that the support slot is equidistant from the first support aperture by the distance, thereby allowing the at least one first bracket member to be disposed in a plurality of positions relative to the at least one vertical mounting member.

7. The apparatus of claim 6, wherein the plurality of pivot pins and the plurality of support receptacles are matingly threaded.

8. The apparatus of claim 6, wherein the first bracket member and the second bracket member are further configured to removably receive a shield.

9. The apparatus of claim 6, wherein the at least one vertical mounting member further includes a first side and a second side, and the at least one vertical mounting member is configured such that the first and the second bracket members can be removably secured to the first side simultaneously.

10. The apparatus of claim 6, wherein the at least one vertical mounting member further includes a first side and a second side, and the at least one vertical mounting member is configured such that the first and the second bracket members can be removably secured to the first and the second sides, respectively, simultaneously.

* * * * *